US010514225B2

(12) United States Patent
Cauley, Jr. et al.

(10) Patent No.: US 10,514,225 B2
(45) Date of Patent: Dec. 24, 2019

(54) FIREARM SHOOTING REST

(71) Applicant: BATTENFELD TECHNOLOGIES, INC., Columbia, MO (US)

(72) Inventors: Dennis W. Cauley, Jr., Booneville, MO (US); James Tayon, Moberly, MO (US); Michael Cottrell, Columbia, MO (US); Timothy Kinney, Warrenton, MO (US); James Gianladis, Harrisburg, MO (US); Michael Poehlman, Columbia, MO (US); Mark Dalton, Columbia, MO (US); Joel Yuodsnukis, Columbia, MO (US); Matthew Kinamore, Columbia, MO (US); Adam J. Birk, Hallsville, MO (US); Justin Burke, Columbia, MO (US); Anthony Vesich, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 15/873,620

(22) Filed: Jan. 17, 2018

(65) Prior Publication Data

US 2019/0219353 A1 Jul. 18, 2019

(51) Int. Cl.
*F41A 23/14* (2006.01)
*F41A 23/16* (2006.01)

(52) U.S. Cl.
CPC ..... *F41A 23/14* (2013.01); *F41A 23/16* (2013.01)

(58) Field of Classification Search
CPC ..... F41A 23/02; F41A 23/04; F41A 23/06; F41A 23/08; F41A 23/10; F41A 23/12; F41A 23/14; F41A 23/16
(Continued)

(56) References Cited

U.S. PATENT DOCUMENTS 197,397 A 11/1877 O'Neil
387,411 A 8/1888 Gisel
(Continued)

FOREIGN PATENT DOCUMENTS

| | | |
|---|---|---|
| DE | 838872 | 5/1952 |
| EP | 0624455 | 11/1994 |
| GB | 475080 | 11/1937 |

OTHER PUBLICATIONS

Joe's, "Shooter's Ridge Steady Point Shooting Rest," http://www.joessports.com/product/index.jsp?productId=3155005&cp=726872&parentPag . . . , Item No. 3155005, 1 pg. [Internet accessed Jul. 17, 2008].

(Continued)

*Primary Examiner* — Bret Hayes
(74) *Attorney, Agent, or Firm* — Stinson LLP

(57) ABSTRACT

A shooting rest and associated methods. The shooting rest includes a forward support and a rear support both supported by a frame. The forward support is configured to clamp a forward portion of the firearm and permit rotation of the firearm with respect to the frame about a pitch axis to adjust a vertical aim of the firearm and about a yaw axis to adjust a horizontal aim of the firearm. The rear support includes a platform positioned to support a bottom of a trigger hand grip portion of the firearm. The platform is adjustable in elevation to adjust the vertical aim of the firearm.

27 Claims, 13 Drawing Sheets

(58) Field of Classification Search
USPC ..... 42/94
See application file for complete search history.

(56) References Cited

U.S. PATENT DOCUMENTS

| | | | |
|---|---|---|---|
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,499,748 | A | 5/1922 | Papouchis |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthornet et al. |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 3,064,976 | A | 11/1959 | Kuhn |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,473,673 | A | 10/1969 | Porter |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman, Sr. |

(56) References Cited

U.S. PATENT DOCUMENTS 3,804,238 A 4/1974 Howard
3,813,816 A 6/1974 Funk
3,815,270 A 6/1974 Pachmayr
3,826,559 A 7/1974 Berliner et al.
3,827,172 A 8/1974 Howe
3,842,527 A 10/1974 Low
D233,853 S 12/1974 Ferrara
3,876,078 A 4/1975 Gomes et al.
3,877,178 A 4/1975 Campanelli
3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins
4,007,554 A 2/1977 Helmstadter
4,012,860 A 3/1977 Auger
4,018,339 A 4/1977 Pritz
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perone, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,207,699 A 6/1980 Hensley
4,222,305 A 9/1980 Lee
4,223,588 A 9/1980 Simpson
4,233,748 A 11/1980 Ford et al.
D257,687 S 12/1980 Bechtel
4,265,045 A 5/1981 Garbini
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr. et al.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylla
4,446,900 A 5/1984 Markovich
4,449,314 A 5/1984 Sorensen
4,462,598 A 7/1984 Chalin et al.
4,477,082 A 10/1984 McKenzie et al.
4,480,411 A 11/1984 Blaz et al.
4,501,071 A 2/1985 Manske
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 Shaine
4,715,476 A 12/1987 France
4,715,499 A 12/1987 Franklin
4,716,673 A 1/1988 Williams et al.
4,721,205 A 1/1988 Burt et al.
4,723,472 A 2/1988 Lee
4,729,186 A 3/1988 Rieger
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,815,593 A 3/1989 Brown
4,819,359 A 4/1989 Bassett
4,821,256 A 4/1989 Schmidt et al.
4,821,422 A 4/1989 Porter
4,821,443 A 4/1989 Bianco et al.
4,823,673 A 4/1989 Downing
4,824,086 A 4/1989 Ridding et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,877,131 A 10/1989 Patros et al.
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,923,402 A 5/1990 Marshall et al.
4,924,616 A 5/1990 Bell
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.

(56) References Cited

U.S. PATENT DOCUMENTS 5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr.
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A 8/1993 Shaw
5,235,764 A 8/1993 Perazzi
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,320,217 A 6/1994 Lenarz
5,320,223 A 6/1994 Allen
5,328,029 A 7/1994 Chow et al.
5,332,185 A 7/1994 Walker, III
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,354,247 A 10/1994 Wilkinson
5,358,254 A 10/1994 Yeh et al.
5,361,505 A 11/1994 Faughn
5,367,232 A 11/1994 Netherton et al.
5,370,240 A 12/1994 Hand
5,375,377 A 12/1994 Kenton
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 DeVries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
D369,904 S 5/1996 Taylor
5,501,467 A 6/1996 Kandel
5,525,314 A 6/1996 Hurson
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A 3/1998 Winnard
5,737,865 A 4/1998 Brandl et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,791,499 A 8/1998 Zebbedies
5,811,720 A 9/1998 Quinnell et al.
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,131 A 6/1999 Hossain et al.
5,913,422 A 6/1999 Cote et al.
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,937,561 A 8/1999 Abernethy
5,959,613 A 9/1999 Rosenbreg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper et al.
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros
6,092,662 A 7/2000 Frederick, Jr. et al.
6,110,020 A 8/2000 Rolfi
6,121,556 A 9/2000 Cole
6,237,462 B1 5/2001 Hawkes et al.

(56) References Cited

U.S. PATENT DOCUMENTS 6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore et al.
6,397,720 B1 6/2002 Fox et al.
6,439,515 B1 8/2002 Powers
6,439,530 B1 8/2002 Schoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,557,855 B2 5/2003 Wu
6,574,899 B1 6/2003 Mostello
6,575,469 B2 6/2003 Love
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,860,055 B1 3/2005 Walrath
6,862,833 B1 3/2005 Gutner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,043,862 B2 5/2006 Franks
7,055,279 B2 6/2006 Flores
7,062,979 B2 6/2006 Day et al.
D524,541 S 7/2006 Cauley
7,086,192 B2 8/2006 Deros
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,200,966 B2 4/2007 Gooder
7,201,376 B2 4/2007 Kuosa
7,207,567 B1 4/2007 Brown
D543,604 S 5/2007 Minneman
7,213,494 B2 5/2007 James
7,216,404 B1 5/2007 Doyle
7,222,451 B2 5/2007 Keng et al.
7,225,050 B2 5/2007 Sutula, Jr.
7,246,704 B2 7/2007 Brunson et al.
7,258,345 B2 8/2007 Anderson, Jr.
D553,219 S 10/2007 Potterfield
7,281,346 B1 10/2007 Cook et al.
D567,895 S 4/2008 Cauley
7,356,960 B1 4/2008 Knitt
7,356,961 B2 4/2008 Williams
7,357,250 B2 4/2008 Hagemann
7,363,740 B2 4/2008 Kincel
7,367,451 B2 5/2008 Pendergraph et al.
7,401,431 B2 7/2008 Pierce et al.
7,410,053 B2 8/2008 Bowen et al.
D576,245 S 9/2008 Potterfield et al.
7,421,815 B1 9/2008 Moody et al.
7,426,800 B2 9/2008 Pierce et al.
7,431,247 B2 10/2008 Bobro
7,481,015 B2 1/2009 Mays
7,536,819 B2 5/2009 Popikow
7,536,820 B2 5/2009 Wade et al.
7,549,247 B1 6/2009 Reese
7,584,690 B2 9/2009 Cauley
D605,246 S 12/2009 Hobbs
7,631,455 B2 12/2009 Keng et al.
7,631,877 B2 12/2009 Zara
7,654,498 B1 2/2010 Beltz
7,658,140 B2 2/2010 Lombardi
7,665,241 B2 2/2010 Oz
7,676,977 B1 3/2010 Cahill et al.
7,681,886 B2 3/2010 Morrow et al.
7,694,973 B1 4/2010 Hofmeister
7,713,180 B2 5/2010 Wickens et al.
7,726,478 B2 6/2010 Potterfield et al.
7,730,824 B1 6/2010 Black
7,743,544 B2 6/2010 Laney et al.
7,774,972 B2 8/2010 Potterfield et al.
7,779,572 B2 8/2010 Potterfield et al.
7,823,317 B2 11/2010 Potterfield et al.
7,845,267 B2 12/2010 Potterfield et al.
7,866,081 B2 1/2011 Seuk
7,883,396 B2 2/2011 Potterfield et al.
7,954,272 B2 6/2011 Potterfield et al.
7,997,021 B2 8/2011 Cauley
8,011,129 B2 9/2011 Cauley et al.
8,104,212 B2 1/2012 Potterfield et al.
8,296,988 B2 10/2012 Yale et al.
8,336,708 B2 12/2012 Potterfield et al.
8,371,057 B2 2/2013 Coffield et al.
8,444,056 B2 5/2013 Gamez et al.
8,496,212 B2 7/2013 Keng et al.
8,621,773 B2 1/2014 Morrow et al.
9,151,561 B2 10/2015 Morrow et al.
2002/0195752 A1 12/2002 Yang
2003/0234205 A1 12/2003 McGuyer et al.
2004/0112777 A1 7/2004 Huang
2004/0134113 A1 7/2004 Deros et al.
2005/0115137 A1 6/2005 Minneman
2006/0065560 A1 3/2006 Dickenson et al.
2006/0175213 A1 8/2006 Hurt et al.
2006/0230664 A1 10/2006 Eddins
2006/0254111 A1 11/2006 Giauque et al.
2006/0277811 A1 12/2006 Peterson
2007/0051028 A1 3/2007 Stordal
2007/0068379 A1 3/2007 Sween et al.
2007/0068835 A1 3/2007 Buie, III
2007/0094911 A1 5/2007 Rush et al.
2007/0113460 A1 5/2007 Potterfield et al.
2007/0256346 A1 11/2007 Potterfield et al.
2007/0295197 A1 12/2007 Potterfield
2008/0023379 A1 1/2008 Potterfield et al.
2008/0054570 A1 3/2008 Potterfield et al.
2008/0061509 A1 3/2008 Potterfield
2008/0128002 A1 6/2008 Jeffs
2008/0156671 A1 7/2008 Jansson
2008/0174071 A1 7/2008 Potterfield et al.
2008/0178641 A1* 7/2008 Himmen ..... F16B 2/10 70/57
2008/0263928 A1 10/2008 Potterfield
2009/0126250 A1 5/2009 Keng
2009/0188146 A1 7/2009 Werner
2010/0102178 A1 4/2010 Smith et al.
2010/0126055 A1 5/2010 Potterfield
2010/0138032 A1 6/2010 Potterfield
2010/0236125 A1 9/2010 Morrow et al.
2010/0270201 A1 10/2010 Cauley et al.
2011/0024985 A1 2/2011 Potterfield et al.
2011/0036214 A1 2/2011 Potterfield
2011/0094140 A1 4/2011 Letson
2012/0175844 A1 7/2012 Potterfield
2015/0354913 A1 12/2015 Morrow et al.

(56) References Cited

U.S. PATENT DOCUMENTS

OTHER PUBLICATIONS

Lahti Company, Evaluator Brochure, http://www.lathicompany.com/Forms/EvaluatorBrochure2.jpg, 2 pgs., accessed Jan. 16, 2006.
MacksPW.com, "Desert Mountain Bench Master Rifle Rest," http://www.macksqw.com/Item-i-DESBM1, © 2004-2008, 1 pg. [Internet accessed Jul. 22, 2008].
Midway USA, "Shooters Ridge Steady Point Rifle Shooting Rest," http://www.midwayusa.com/eproductpage.exe/showproduct?saleitemid=826745&t=11082005, 2005, 5 pgs. [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pgs. [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pgs. [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pgs. [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pgs. [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pgs. [Internet accessed on Aug. 6, 2008].
MidwayUSA, "CTK Precision P3 Ultimate Shooting Rest," http://www.midwayusa.com/eproductpage.exe/showproduct?saleitemid=114699&t=11082005, 2005, 2 pgs. [Internet accessed on Aug. 6 20081.
MidwayUSA, "Hyskore® dangerous Game Rifle Shooting Rest," http://www.midwayusa.com/eproductpage.exe/showproduct?saleitemid=729197&t=11082005, 2005, 3 pgs. [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 3 pgs. [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005,2005, 3 pgs. [Internet accessed on Aug. 6, 2008].
MidwayUSA, "Shooters Ridge Steady Point Rifle Shooting Rest with Vise," http://www.midwayusa.com/eproductpage.exe/showproduct?saleitemid=341095&t=11082005, D 2005, 4 pgs. [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pgs. [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pgs. [Internet accessed on Aug. 6, 2008].
Milek, B., "Handloaling for Hunting" New Products from RCBS, Lee, Accurate Arms, Peterson's Hunting, Mar. 1985, p. 21. 1 pg.
Precision Shooting, Inc., Bald Eagle Front Rest, The Accurate Rifle, vol. 6, Issue No. 4, May 2003, p. 47. 1 pg.
Protektor Model, "The Original Leather Rifle and Pistol Rest," http://www.protektormodel.com/, 12 pgs. [Internet accessed on Feb. 14, 2006].
Shooters Ridge, "Deluxe Rifle Rest," http://www.shootersridge.com, 1 pg. [Internet accessed Jul. 21, 2008].
Shooters Ridge, "Shooting Rest with Gun Vise," http://www.shootersridge.com, 1 pg. [Internet accessed Jul. 17, 2008].
Sinclair International, Sinclair Shooting Rests, Products for the Precision Shooter, 2002, Issue No. 2002-B, pp. 76-78.
Sweeney, P "Gunsmithing: Measure Headspace," Peterson's Rifleshooter, http://www.rifleshootermag.com/gunsmithing/headspace_0612/, 4 pgs. [Internet Accessed Dec. 11, 2004].
Cabela's, "Sharp Shooter Rifle Rest," http://www.cabelas.com/cabelas/en/templates/links/link.jsp?id=0005816222738a&type=product&cmCat=, © 1996-2008, 2 pgs. [Internet accessed on Aug. 6, 2008].
"American Rifleman: What to do about recoil," LookSmart, http ://www.findarticles.com/p/articles/mi_qa3623/is_199907/ai_n886159/print, pp. 1-4, accessed Jan. 4, 2006.
"Uncle Bud's Bull Bags," http:www.unclebudscss.com/pages/Bulls%20bags.html, 2 pgs. [Internet accessed on Feb. 14, 2006].
"Uncle Bud's Udder Bag," http:www.unclebudscss.com/pages/Udder%20Bags.html, 2 pgs. [Internet accessed on Feb. 14, 2006].
Amazon.com, "CTK® P3 Ultimate Shooting Rest," Sports & Outdoors, http://www.amazon.com/CTK%C2%AE-P3-Uitimate-Shooting-Rest/dp/ . . . , 1 pg. [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 pg. [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/BO . . . , 1 pg. [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product 10151-1 10001 95064 SearchResults, 2 pgs. [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," file://C:\DOCUME-1\DUTCD\LOCALS-1\Temp\PQ28V28J.htm, 1 pg., accessed Jan. 25, 2006.
Big Boy Gun Toys, "Shooting Rest," http://www.bigboyguntoys.com/shootingrest.htm, 1 pg. [Internet accessed on Jul. 18, 2008].
Boyt Harness Company, Product Catalog, http://www.boytharness.com/catalog/index.php?cPath=22, 2 pgs. [Internet accessed on Jul. 21, 2008].
Brownells, Inc., Catalog No. 41, 1988-1989, 3 pgs.
Brownells, Inc., Catalog No. 57, 2004-2005, 2 pgs.
Brownells, Inc., Catalog No. 47, 1994-1995, 2 pgs.
Brownells, Inc., Sight Base Cutters, Faxed Dec. 17, 2003, 1 pg.
Cabela's Hunting Fishing and Outdoor Gear Master Catalog, Fall2002, Edition II, Minimizer Rifle Rest, Item No. SC-22-4332 and SC-22-4333, p. 492.
Cabela's, "BenchBuddy® Gun Rest," http://www.cabelas.com/cabelas/en/templates/links/link.jsp?id=0005819221954a&type=product&cmCat=, © 1996-2008, 2 pgs. [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pgs. [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pgs. [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pgs. [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pgs. [Internet accessed on Aug. 6, 2008].

(56) References Cited

OTHER PUBLICATIONS

Cabela's, "Premier Rifle Rest," http://www.cabelas.com/cabelas/en/templates/links/link.jsp?id=0020904227856a&type=product&cmCat= . . . , © 1996-2008, 2 pgs. [Internet accessed on Aug. 6, 2008].
Cabela's, "Secure Bench Rest," http://www.cabelas.com/cabelas/en/templates/links/link.jsp;jsessionid=4F0LP0OW2HMRLLAOBBISCOF . . . , © 1996-2008, 2 pgs. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pgs. [Internet accessed on Aug. 6, 2008].
Cabela's, "Shooting Benches & Portable Rifle Shooting Bench Rest," http://www.cabelas.com/ssubcat-1/cat20793.shtml, 3 pgs. [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pgs. [Internet accessed on Jul. 15, 2008].
Caldwell Shooting Supplies, 2006 Catalog, pp. 18, 5, 12, 14 and 15. 5 pgs.
Californiavarmintcallers.com—Forum, http://californiavarmintcallers.com/community/modules/newbb/viewtopic.php?topic_id=10&forum=9&PHPSESSID=074ed8c7 . . . pp. 1-4 accessed Jan. 16, 2006.
Canadian Camo, "Gun Rest," https://media5.magma.ca/www.canadiancamo.com/catalog/product_info.php?products_id= . . . , 2 pgs. [Internet accessed on Feb. 13, 2006].
Champion Traps & Target, 2005 Product Catalog, 12 pgs.
CTK Precision, "P3 Ultimate Shooting Rest," http://www.ctkprecision.com/index.asp?PageAction=VIEWPROD&ProdOID=2, 3 pgs. [Internet accessed on Jul. 18, 2008].
CTK Precision, All Products, http://www.ctkprecision.com/index.asp?PageAction=VI EWCATS&Cate . . . , 3 pgs. [Internet accessed on Jul. 22, 2008].
E. Arthur Brown Company, "A Shooting Rest that Really Works . . . ," http://www.eabco.comfTargetShooting01.html, © 2007-2008, 1 pg. [Internet accessed Jul. 18, 2008].
Edgewood Shooting Bags Catalog, http://www.edgebag.com/catalog.php, 7 pgs. [Internet accessed on Feb. 14, 2006].
Grafix® Plastics, http://www.grafixplastics.com/plastic_film_g.asp?gclid=CK-5-7gnY4CFRVNhQodjFhfSQ, 29 pgs. [Internet accessed on Aug. 30, 2007].
"Gun Rest-Shooting Rest-Rifle Rests," http://www.exploreproducts.com/gunrests-shootingrests.htm, 6 pgs. [Internet accessed Jul. 18, 2008].
Hyskore, "Rest—Dangerous Game Machine Rest," Hyskore Rest, Professional firearm rests, http://www.hyskore.com/rests.htm, 2 pgs. [Internet accessed Jul. 21, 2008].
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Really Right Stuff Vyce Photos, 3 Pages, at Least as Early as Jan. 1, 2018.
Vyce Equipment Support Mount, 2 Pages, at Least as Early as Jan. 1, 2018 (Internet Accessed May 25, 2018).
Hog Saddle PIG0311-G Field Tripod, 4 Pages, at Least as Early as Jan. 1, 2018 (Internet Accessed May 25, 2018).
MOD7 Hog Saddle, 4 Pages, at Least as Early as Jan. 1, 2018 (Internet Accessed May 25, 2018).
Bog Super Steady Combo, 2 Pages, at Least as Early as Jan. 1, 2017 (Internet Accessed May 25, 2018).

* cited by examiner

FIREARM SHOOTING REST

FIELD

The present disclosure generally relates to firearm accessories, and more particularly to rests for firearms.

BACKGROUND

Various types of firearm rests are known. Shooting rests are used to support part or all of the weight of a firearm to assist a user in shooting the firearm. Shooting rests enable shooters to aim a firearm more steadily at a target and thus improve shooting accuracy.

SUMMARY

In one aspect, a shooting rest is for supporting a firearm including a trigger, a trigger hand grip portion adjacent the trigger, a butt portion rearward from the trigger hand grip portion, and a forward portion forward from the trigger hand grip portion. The shooting rest includes a frame, a forward support, and a rear support. The forward support is supported by the frame and includes a cradle configured to receive the forward portion of the firearm. The cradle is pivotable with respect to the frame to adjust an aim of the firearm. A rearward support is supported by the frame and includes a platform positioned to engage a bottom of the hand grip portion of the firearm to support the hand grip portion.

In another aspect, a shooting rest is for supporting a firearm including a trigger and a forward portion forward of the trigger. The shooting rest includes a frame and a cradle. The cradle is supported by the frame to support the forward portion of the firearm. The cradle includes first and second jaws and a bed between the jaws. The first and second jaws are movable with respect to the bed to clamp the forward portion of the firearm between the jaws. The cradle includes an actuator operatively connected to the first and second jaws. The actuator is operable to move the first and second jaws toward each other at the same time at the same rate of movement.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
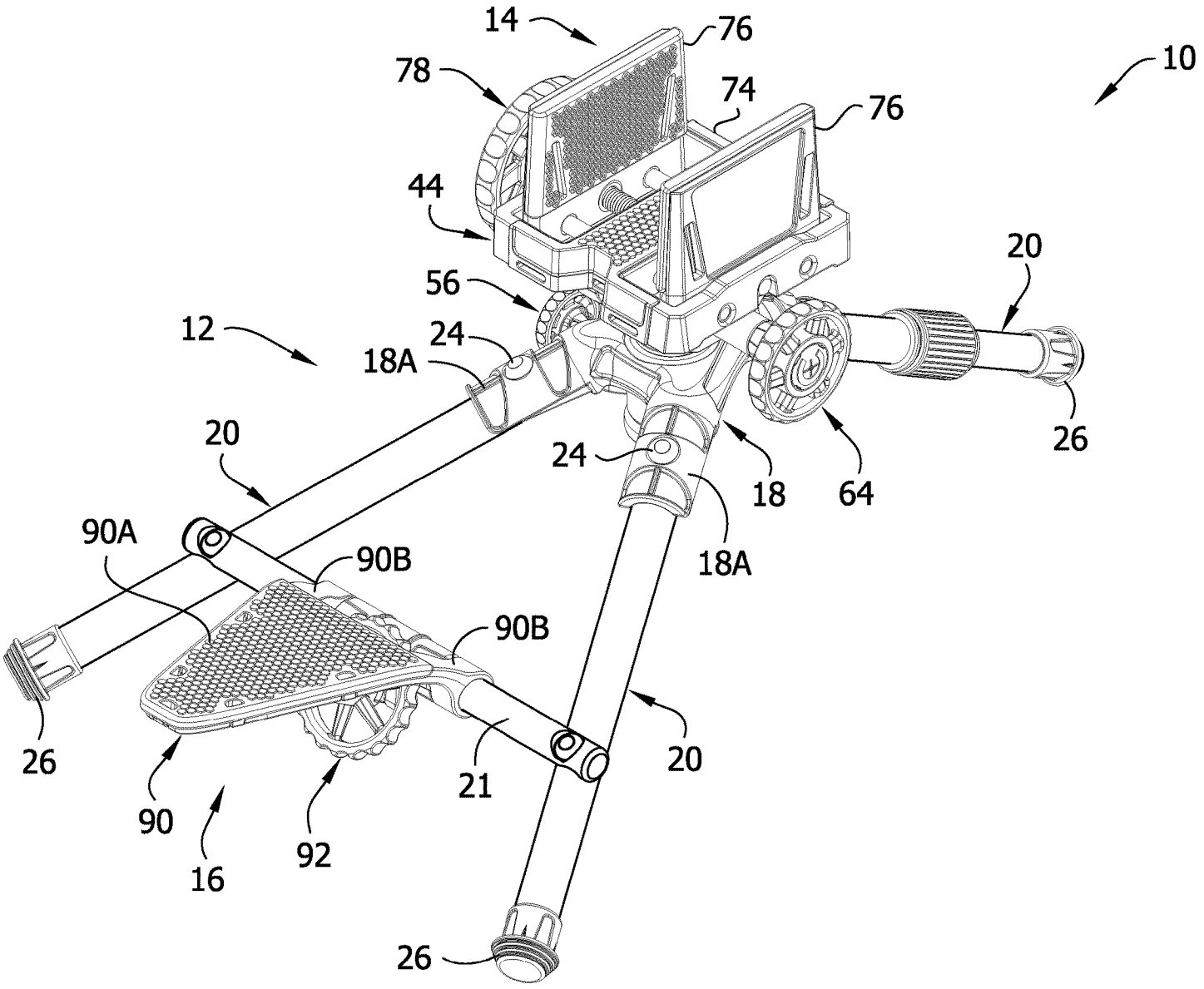
FIG. 1 is a rear perspective of a shooting rest.
Figure 2:
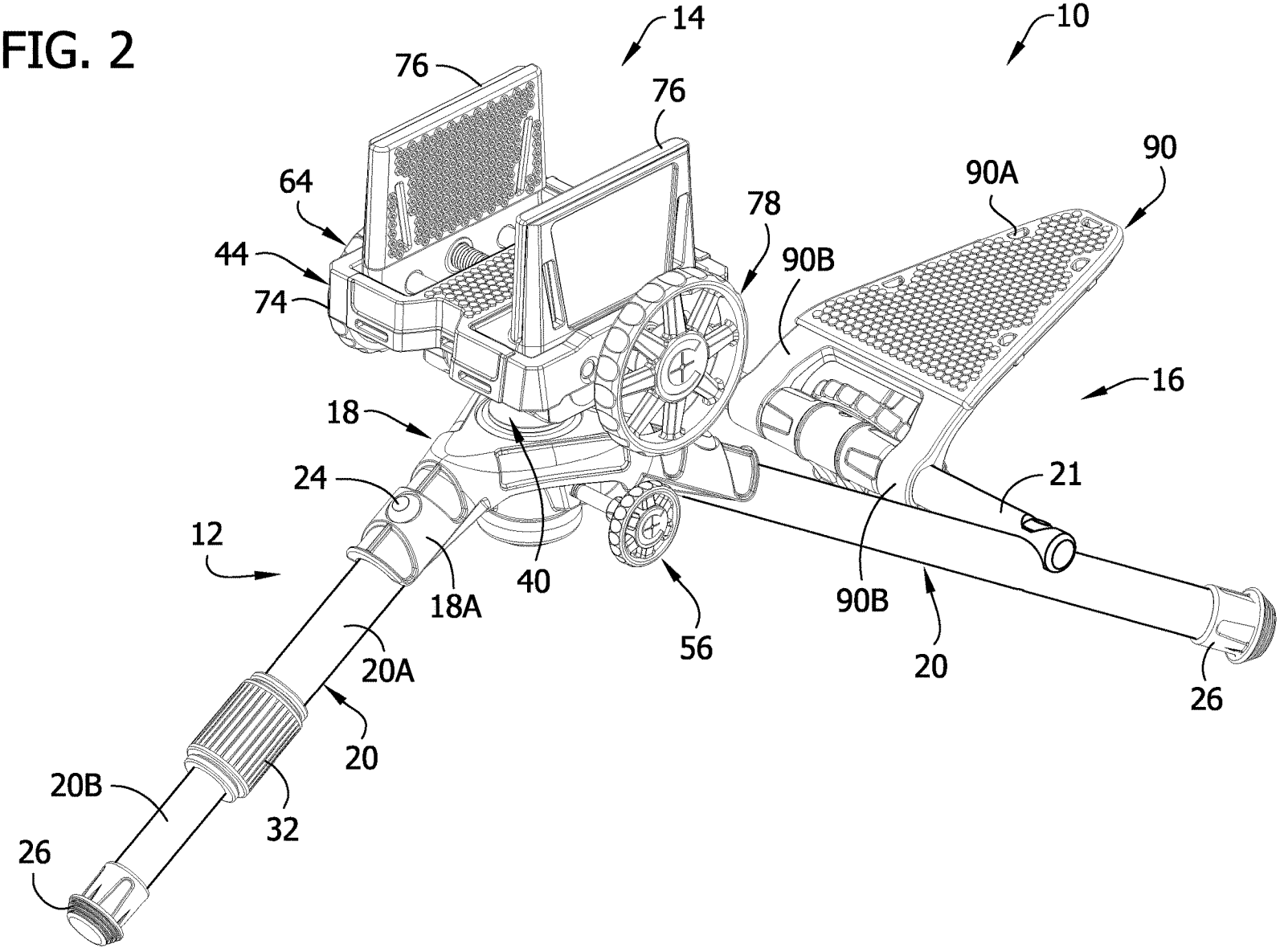
FIG. 2 is a front perspective of the shooting rest.
Figure 3:
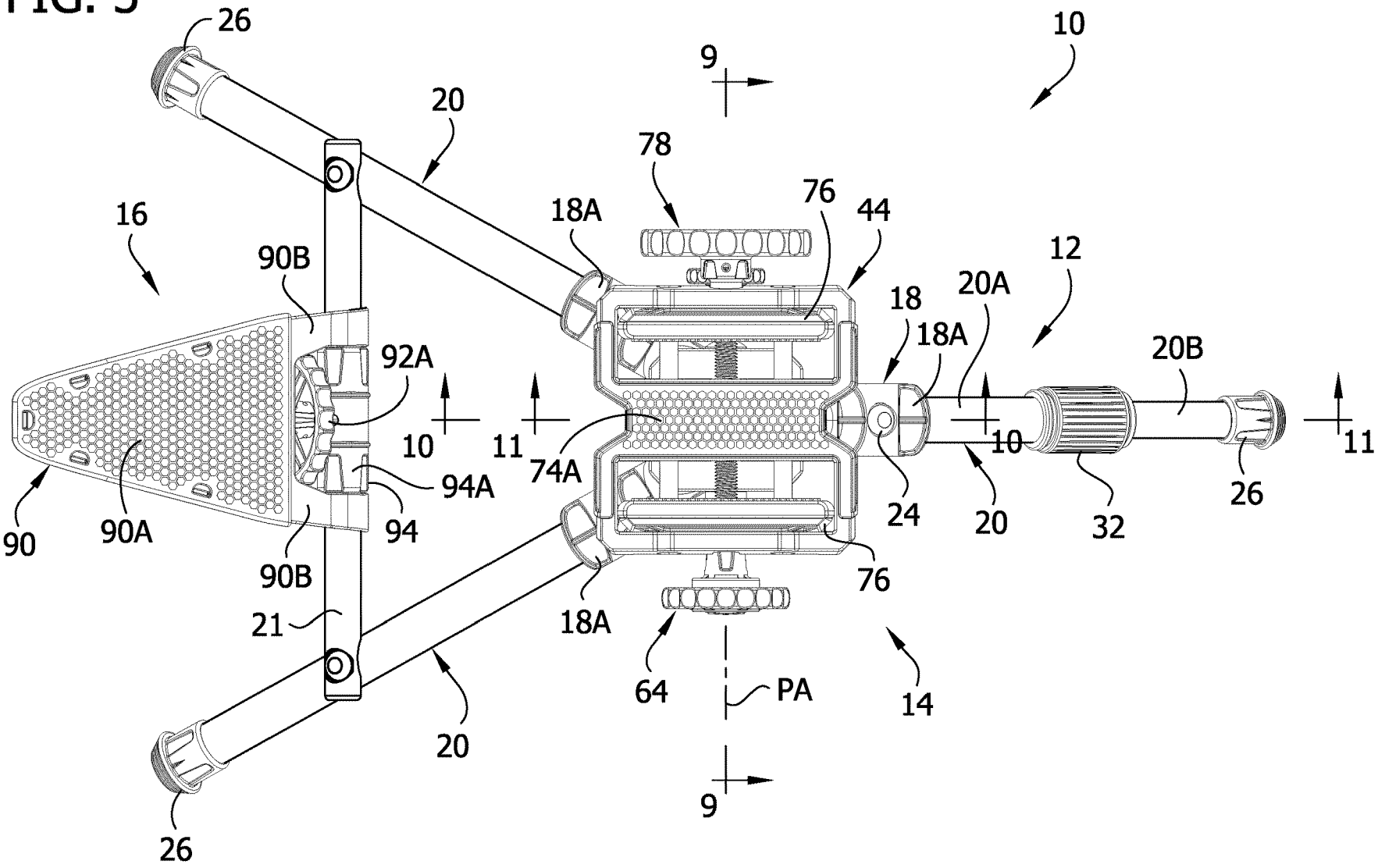
FIG. 3 is a top view of the shooting rest.

Referring to FIGS. 1-3, a firearm shooting rest is designated generally by the reference number 10. The shooting rest 10 is configured to support a firearm F (FIG. 4) while a user is aiming and firing the firearm. As explained in further detail below, the shooting rest 10 can be used in a bench rest mode and in a turret rest mode. If desired, the rest 10 could be used as a vise to hold a firearm in position for maintenance or gunsmithing procedures. The shooting rest 10 is intended for use with a long gun such as an AR-15 rifle, but other types of firearms can be used on the rest. Components of the shooting rest can be made of metal and/or plastic or any other suitable material.

Figure 4:
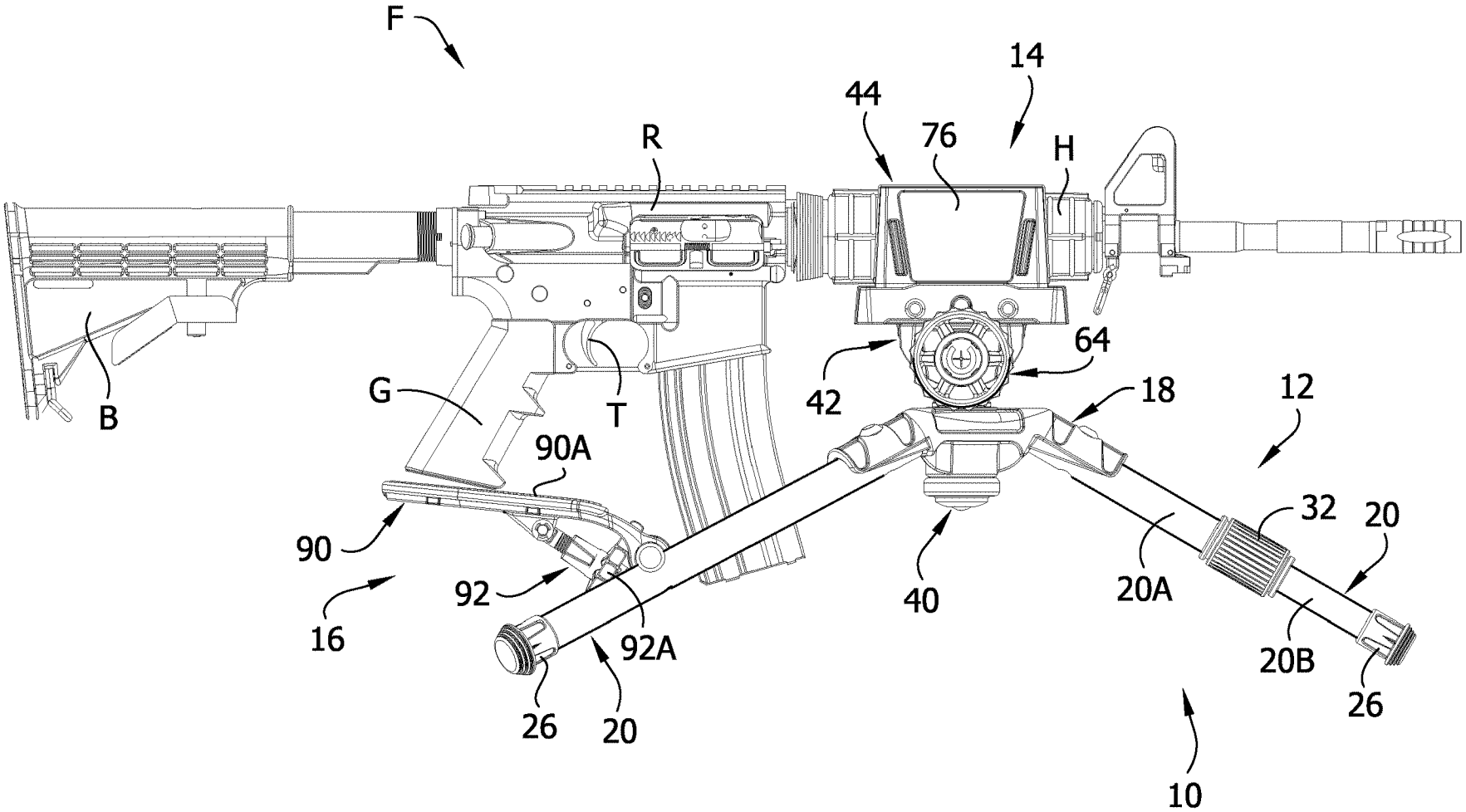
FIG. 4 is a side elevation of the shooting rest having an AR-15 rifle supported thereon.
Figure 5:
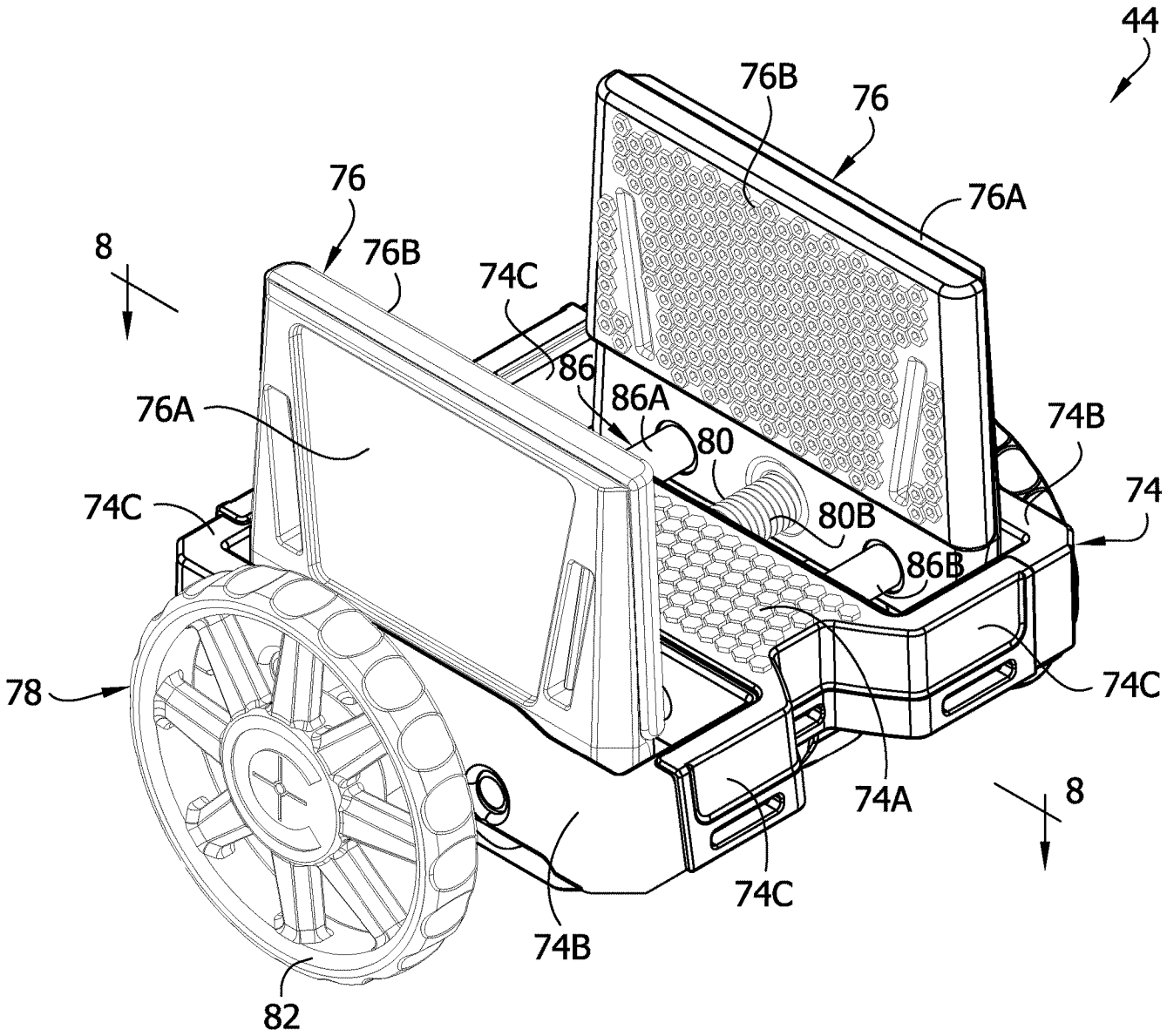
FIG. 5 is a perspective of a cradle of the shooting rest.

In general, the shooting rest includes a frame 12, a forward firearm support 14, and a rear firearm support 16. The shooting rest 10 is arranged for the forward support 14 to support a forward portion of the firearm and for the rear support 16 to support a bottom of a hand grip portion of the firearm. The rear support 16 can be removable or can be omitted without departing from the scope of the present invention. Referring to FIG. 4, an AR-15 rifle indicated at F is shown mounted on the shooting rest 10. The rifle F includes a trigger T and a receiver R (including upper and lower receivers). Near the trigger T, the rifle F includes a pistol style hand grip G (broadly, "trigger hand grip portion") that a user grips with fingers of the same hand that engages the trigger. Rearward from the trigger T, the rifle F includes a buttstock B (broadly, "butt portion") configured to engage a shoulder of the user. In front of the trigger T, the rifle F includes a hand guard H (broadly, "forward portion"). When the rifle F is resting on the shooting rest 10, the hand guard H rests on the forward support 14, and the bottom of the pistol style hand grip G rests on the rear support 16. It will be appreciated that the rest 10 can be used to support other types of long guns without departing from the scope of the present invention. For example, shotguns and other rifles can be used. It will be appreciated that all long guns have a trigger hand grip portion to be grasped by the fingers of the user's trigger hand, although the trigger hand grip portion may have other forms than the pistol style hand grip of the illustrated AR-15 rifle. Moreover, other types of long guns may have a different type of forward portion, such as a forestock, a barrel, etc. that would rest on the forward support 14.

In the illustrated embodiment, the frame 12 is provided in the form of a stand having a tripod configuration. The frame 12 includes a yoke 18 and a three legs 20 extending from the yoke. The yoke 18 includes three leg connectors 18A. Each leg 20 includes a proximal end secured to a respective leg connector portion 18A of the yoke 18 by a fastener 24, and each leg includes a distal end opposite the proximal end. Feet 26 are provided at the distal ends for engaging a surface such as a surface of the ground. In the illustrated embodiment, the legs 20 extend from the yoke 18 in fixed orientations with respect to the yoke. The front leg 20 extends directly forward from the yoke and the rear legs 20 extend laterally and rearward from the yoke. A brace 21 extends between the two rear legs 20. Other types of frames can be used without departing from the scope of the present invention.

Figure 11:
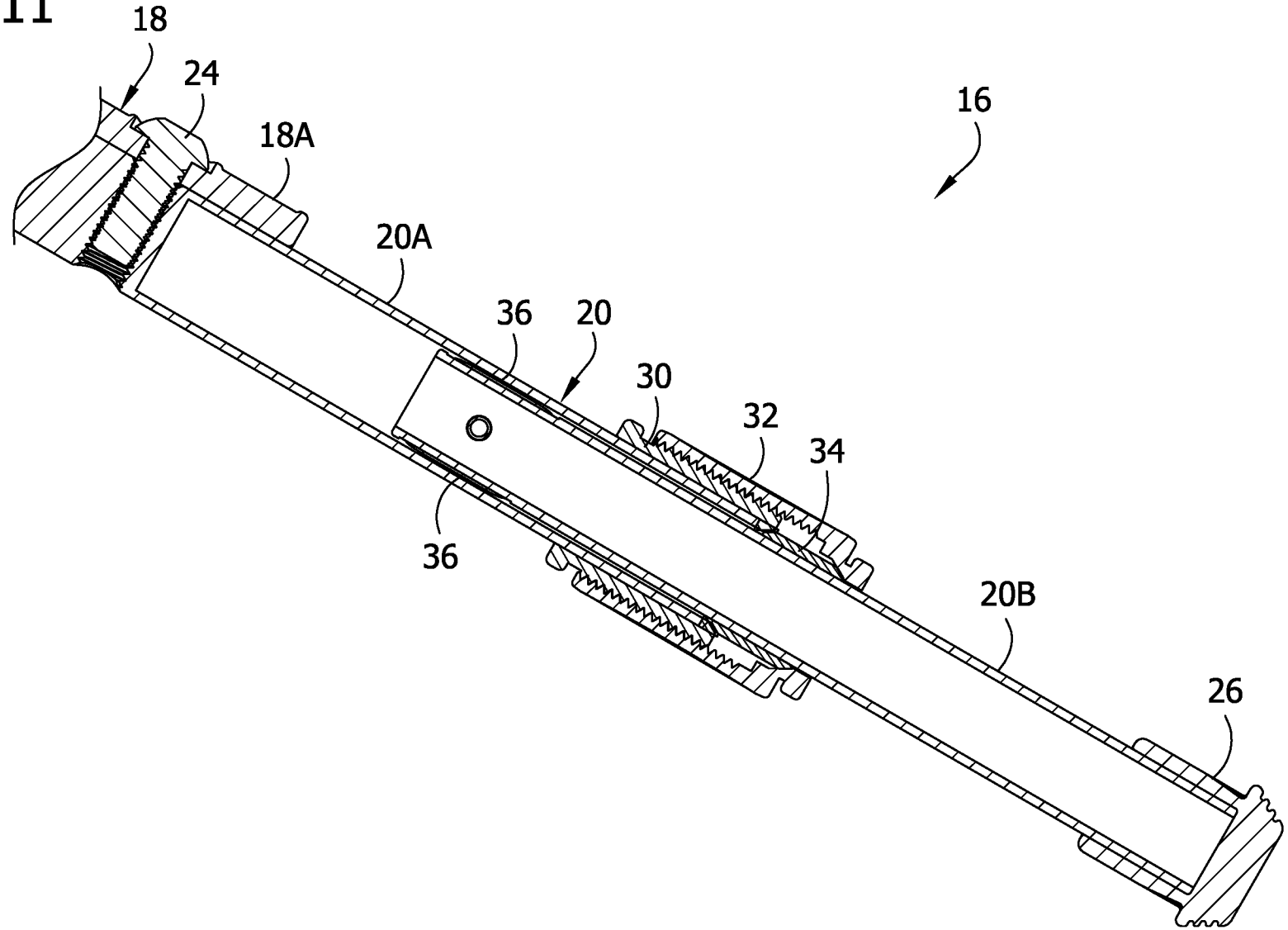
FIG. 11 is a fragmentary section of the shooting rest taken in a plane including line 11-11 indicated in FIG. 3.
Figure 12:
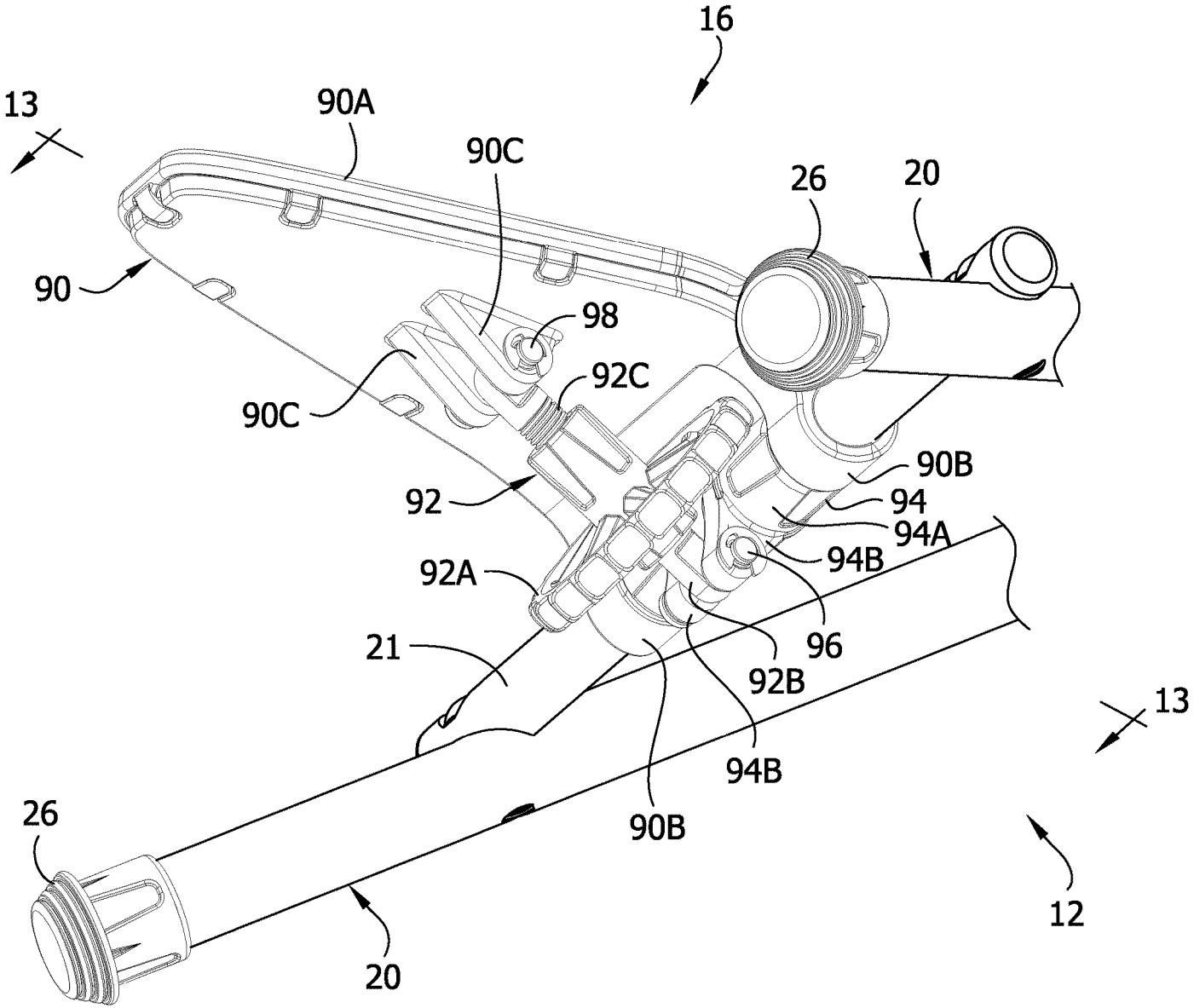
FIG. 12 is a fragmentary bottom perspective of the shooting rest.
Figure 13:
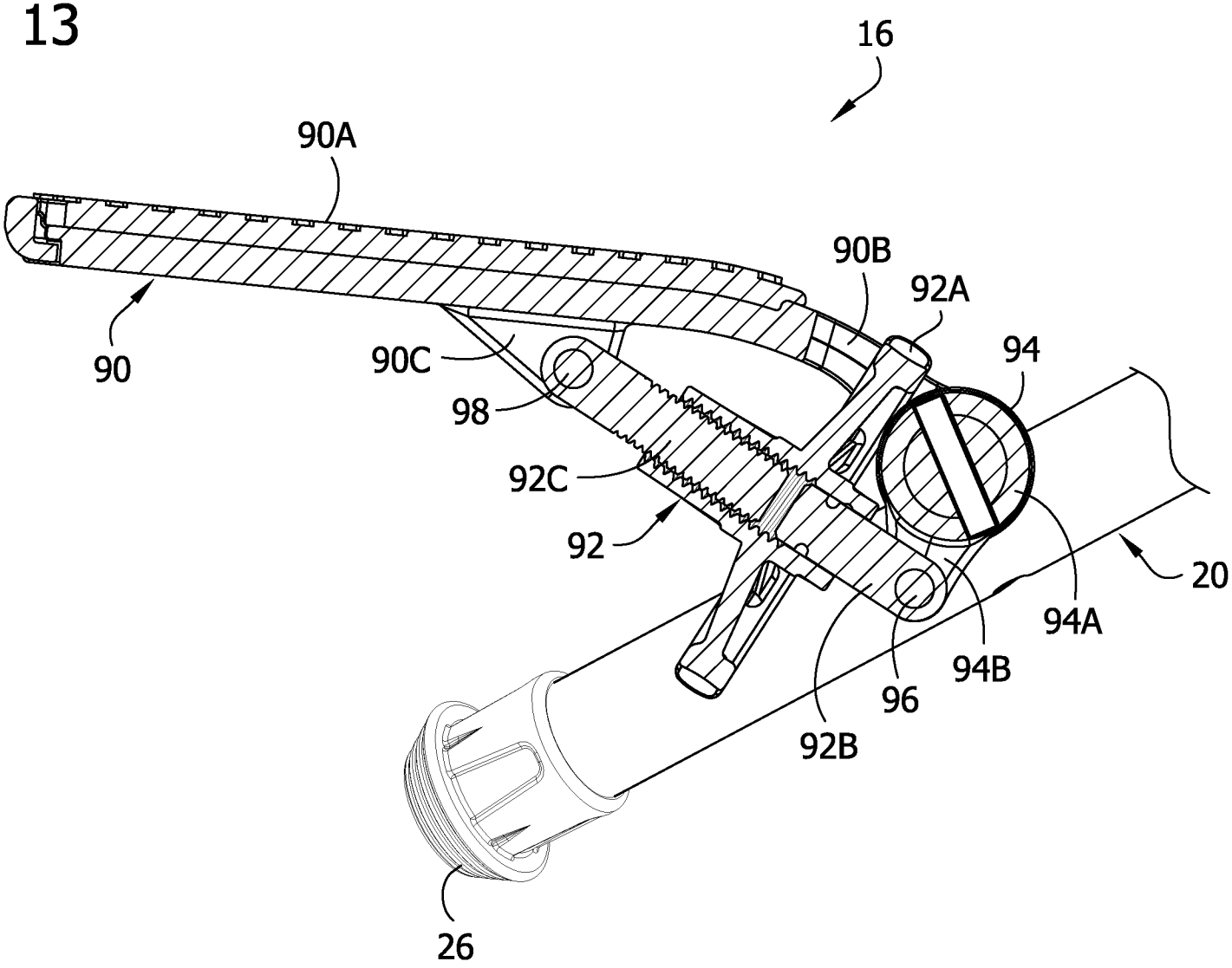
FIG. 13 is a fragmentary section of the shooting rest taken in a plane including line 13-13 indicated in FIG. 12.

Referring to FIGS. 2 and 11, the front leg 20 is configured to adjust in length to provide coarse vertical aiming adjustment of the firearm F and/or to permit leveling of the yoke 18 with respect to the surface on which the rest is resting. The front leg 20 includes an upper leg section 20A and a lower leg section 20B, which is telescopically received in the upper leg section. The length of the front leg 20 is adjustable by telescoping the lower leg section 20B into or out of the upper leg section 20A. A compression connection is provided to releasably lock the front leg 20 at a desired length. The compression connection includes a sleeve 30 mounted on a distal end of the upper leg section 20A, a collar 32 threaded onto the sleeve 30, and a bushing 34 captured by a distal end of the sleeve and by the collar. In a locking configuration, the collar 32 is threaded sufficiently onto the sleeve 30 such that the bushing 34 is compressed by the sleeve and collar against an outer surface of the lower leg section 20B. In particular, the sleeve 30 has a ramped distal portion, and the collar 32 has a ramped distal portion, each of which engages respective ends of the bushing 34 and presses the bushing against the outer surface of the lower leg section 20B when the collar is threaded sufficiently onto the sleeve. To permit sliding of the lower leg section 20B with respect to the upper leg section 20A, the collar 32 is unthreaded sufficiently from the sleeve 30 to decrease friction between the bushing 34 and lower leg section to permit the lower leg section to slide into or out of the compression connection. Spacers 36 are provided at a proximal end portion of the lower leg section 20B to facilitate sliding motion of the lower leg section against an inner surface of the upper leg section 20A. Other configurations can be provided to permit coarse elevation adjustment without departing from the scope of the present invention.

Figure 9:
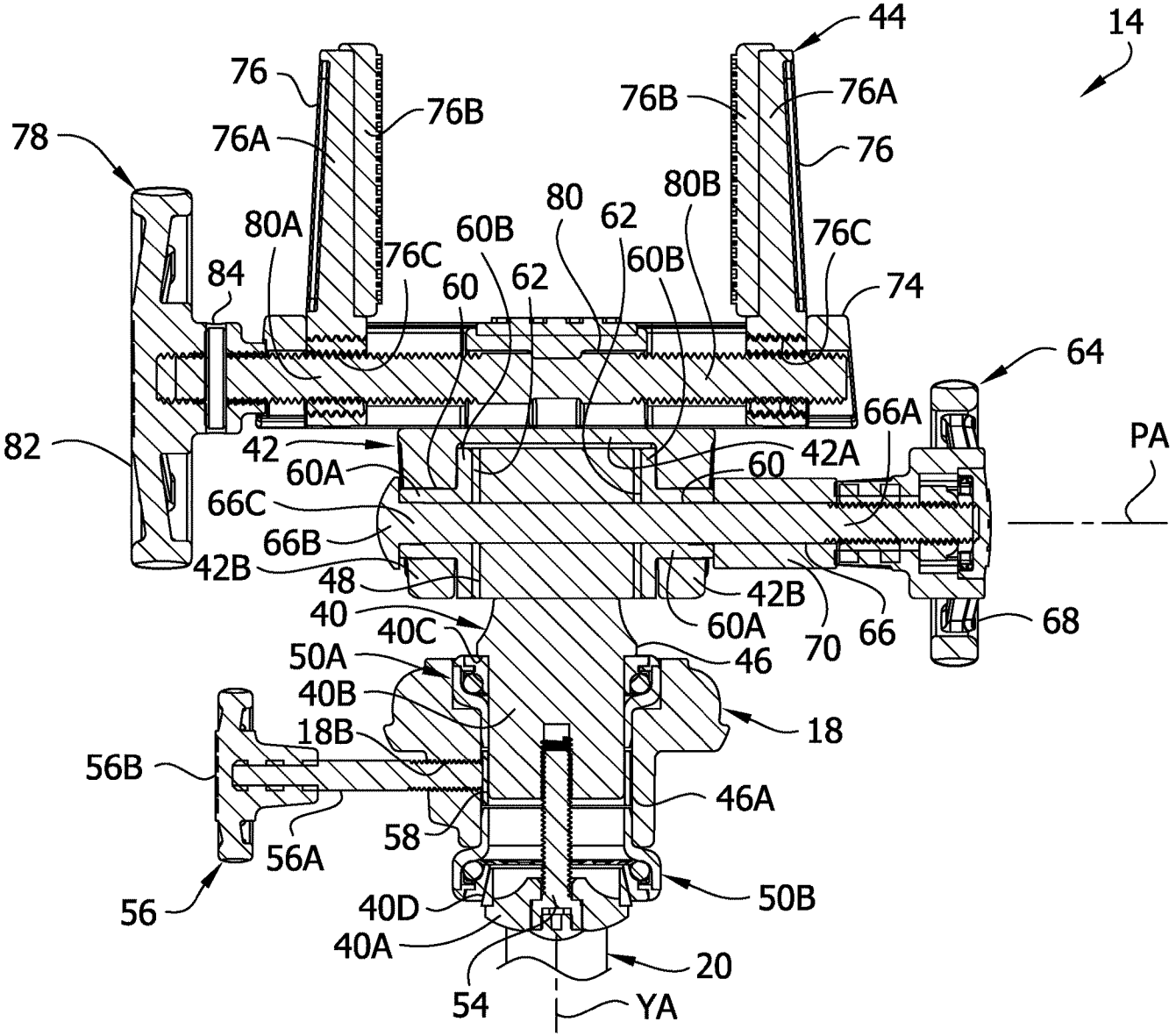
FIG. 9 is a fragmentary section of the shooting rest taken in a plane including line 9-9 indicated in FIG. 3.
Figure 10:
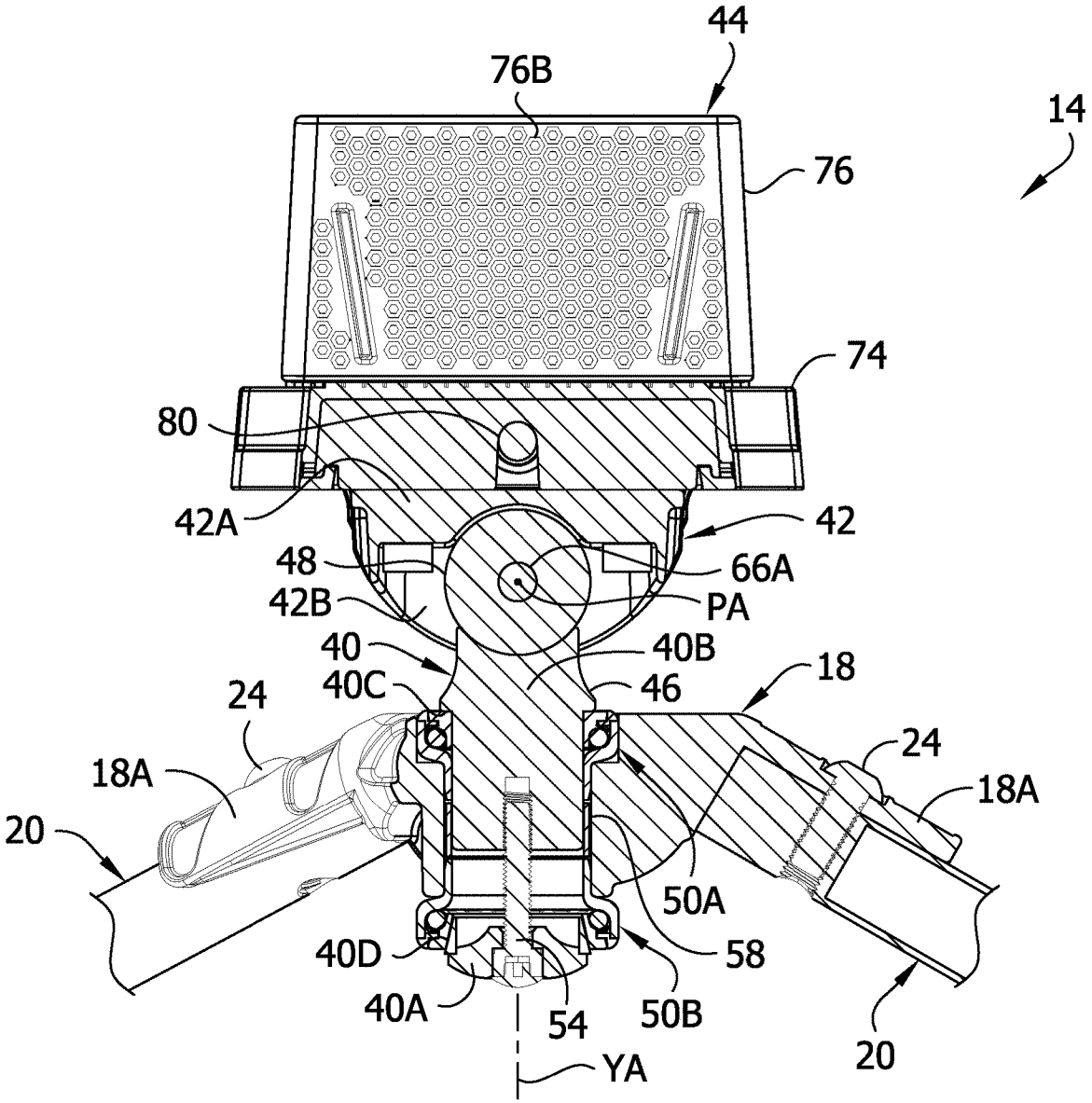
FIG. 10 is a fragmentary section of the shooting rest taken in a plane including line 10-10 indicated in FIG. 3.

Referring to FIGS. 9 and 10, the forward support 14 generally includes a stem 40, a hub 42, and a cradle 44. The arrangement permits rotation of the cradle 44 with respect to the frame 12 about a yaw axis YA for adjusting a horizontal aim of the firearm F and about a pitch axis PA for adjusting a vertical aim of the firearm. The cradle 44 is configured to receive the forward portion H of the firearm. The cradle 44 is connected to the frame 12 by the hub 42 and stem 40. The arrangement includes a first pivot connection of the stem 40 to the yoke 18 that defines the yaw axis YA, and a second pivot connection of the hub 42 to the stem 40 that defines the pitch axis PA. For reasons that will become apparent, the front support 14 can be referred to as a turret support.

The stem 40 includes a post 46 and a head 48. The post 46 extends through an opening in the yoke 18 and is connected to the yoke by an upper bearing 50A and a lower bearing 50B. Each bearing includes an inner race, an outer race, and a plurality of ball bearings between the inner and outer race. The lower bearing 50B includes a shoulder opposing a bottom surface of the yoke 18 and the upper bearing 50A includes a shoulder opposing an internal shoulder of the yoke. The stem 40 is rotatable win the bearings 50A, 50B with respect to the yoke 18 about the yaw axis YA. The stem 40 includes a lower section 40A and an upper section 40B secured to each other by a fastener 54 (e.g., bolt). The lower and upper sections 40A, 40B collectively define a neck 46A of the post 46 extending through the opening in the yoke 18. In manufacture, the upper section 40B may be moved downwardly into the yoke 18, the lower section 40A may be moved upwardly into the yoke, and the fastener 54 may then be installed to secure the upper and lower sections and upper and lower bearings 50A, 50B together. To secure the stem 40 axially in the yoke 18, the upper section 40B includes a shoulder 40C abutting the inner race of the upper bearing 50A, and the lower section 40A includes a shoulder 40D abutting the inner race of the lower bearing 50B.

A yaw brake 56 is provided in the form of an actuator including a threaded shaft 56A and a knob 56B. The threaded shaft 56A is received in a threaded opening 18B in the yoke 18 and has a distal end adjacent the neck 46A of the post 46. Friction of the distal end of the shaft 56A against the neck 46A can be increased or decreased by threading the shaft into or out of the yoke 18 using the knob 56B. In the illustrated embodiment, the neck 46A includes an annular break pad 58 which the distal end of the shaft 56 is positioned to engage. For example, the yaw brake 56 can be configured in a non-braking position, a braking position, or a locking position. In the non-braking position, the shaft 56A of the yaw brake 56 is threaded sufficiently out of the yoke 18 such that the distal end of the shaft is not engaging the neck 46A. In the non-braking position, the stem 40 is free to rotate about the yaw axis YA without braking by the yaw brake 56. In the braking position, the shaft 56A of the yaw brake 56 is threaded into the yoke 18 such that the distal end of the shaft is engaging the neck 46A and dampens rotation of the stem 40 about the yaw axis YA. In particular, friction between the distal end of the shaft 56A and the neck 46A is great enough to resist free pivoting of the stem 40 about the yaw axis YA but to permit rotation about the yaw axis when sufficient force is applied to the firearm F by the user. In the locking position, the shaft 56A of the yaw brake 56 is threaded into the yoke 18 such that the distal end of the shaft is engaging the neck 46A to create sufficient friction to prevent rotation of the stem 40 about the yaw axis YA. In use, the yaw brake 56 will typically be configured in the non-braking position or various degrees of the braking position.

Referring to FIG. 9, a pivot connection is provided between the hub 42 and the stem 40 to permit rotation of the cradle 44 about the pitch axis PA. The head 48 of the stem 40 has a generally cylindrical shape including opposite generally planar side faces, and the head has a bore extending through the head that opens out of the opposite side faces. The hub 42 includes a main body 42A and two arms 42B extending downward from the main body. A gap is provided between the arms 42B, and the head 48 of the stem 40 is received in the gap such that the hub 42 straddles the head with the arms on opposite sides of the head laterally outboard from the head faces.

Still referring to FIG. 9, the pivot connection between the hub 42 and stem 40 further includes brake shoes 60, brake pads 62, and a pitch brake 64. The pitch brake 64 includes an actuator including a carriage bolt 66 and a knob 68 threaded on a threaded portion of a shaft 66A of the carriage bolt. The shaft 66A defines the pitch axis PA and extends through the arms 42B, the brake shoes 60, the brake pads 62, and the stem head 48. The brake shoes 60 each include an outer portion 60A having a hexagonal outer surface and an inner portion 60B forming an inward facing annular engagement surface for engaging the respective brake pad 62. The hexagonal outer portions 60A of the brake shoes 60 are received in hexagonal openings in the arms 42B and are slidable in the openings along the pitch axis PA. The brake pads 62 are provided in the form of washers having opposite annular faces positioned to engage the faces of the brake shoes 60 and the faces of the stem head 48. The brake shoes 60 and brake pads 62 include openings through which the carriage bolt shaft 66A extends. The carriage bolt 66 is prevented from rotating with respect to the brake pad 62 adjacent a head 66B of the carriage bolt 66 by reception of a square section 66C of the carriage bolt shaft in a portion of the brake pad opening having a corresponding square shape. Desirably, the square section 66C of the carriage bolt 66 forms a friction fit with the brake pad 62 such that the brake pad is carried on and moves conjointly with the carriage bolt 66 if the carriage bolt moves axially. The knob 68 is threaded onto the opposite end of the carriage bolt 66 and is spaced from the hub by a spacer 70. The arrangement is such that rotation of the knob 68 tending to thread the knob on the carriage bolt 66 toward the hub 42 causes the brake shoes 60 to press the brake pads 62 against the opposite faces of the stem head 48. In particular, the knob 68 presses the spacer 70 against the right brake shoe 60, and the head 66B of the carriage bolt 66 presses against the left brake shoe 60. The pitch brake 64 can be configured in a non-braking position, a braking position, or a locking position. In the non-braking position, the knob 68 is threaded sufficiently away from the hub 42 to not press the brake shoes 60 toward the stem head 48, thus permitting free rotation of the hub and cradle 44 about the pitch axis PA. In the braking position, the knob 68 is threaded sufficiently toward the hub 42 so that the brake shoes 60 press inwardly against the respective brake pads 62 and thus cause the brake pads to press against the opposite faces of the stem head 48. Friction between the brake shoes 60 and brake pads 62 and friction between the brake pads and stem head 48 dampens rotational movement of the hub 42 about the pitch axis PA. In the locking position, the knob 68 is threaded sufficiently toward the hub 42 so that the brake shoes 60 press inwardly against the respective brake pads 62 to cause the brake pads to press against the stem head 48 with sufficient force to create locking friction. More specifically, the friction between the brake shoes 60 and brake pads 62 and friction between the brake pads and stem head 48 is great enough to prevent rotational movement of the hub 42 about the pitch axis PA. In use, the pitch brake 64 will usually be configured in the non-braking position or some degree of the braking position.

Other configurations for supporting the cradle 44 on the frame 12 can be used without departing from the scope of the present invention. For example, more or fewer than two pivot connections can be used. The yaw axis and pitch axis can be defined by a single pivot connection (e.g., ball pivot connection) or by multiple pivot connections. Other types of yaw and pitch brakes can be used, the yaw brake and pitch brake can be the same brake (e.g., in the case of a ball pivot connection), and the yaw and/or pitch brake can be omitted.

The cradle 44 will now be described in further detail with reference to FIGS. 5-9. In general, the cradle 44 includes a base 74, first and second jaws 76, and a clamp actuator 78 configured to move the jaws with respect to the base. The cradle 44 is configured to secure the forward portion H of the firearm F in the cradle by clamping the forward portion of the firearm. The base 74 defines a bed 74A between the jaws 76 on which the forward portion H of the firearm F can rest. In the illustrated embodiment, the base 74 includes a pad or overmolding of elastomeric material to provide a non-marring surface at the bed 74A for engaging the forward portion H of the firearm F. As shown, the bed 74A is formed by a multiplicity of closely spaced, hexagonal nubs. While the firearm F is resting on the bed 74A, the clamp actuator 78 can be used to move the jaws 76 into clamping engagement with the firearm. The cradle 44 defines a firearm axis FA (FIG. 6) extending between forward and rear ends of the cradle along which the forward portion H of the firearm F extends when clamped by the jaws 76. As will become apparent, the clamp actuator 78 is configured to move the jaws 76 at the same time and at the same rate of movement for clamping the firearm F in a centered position on the bed. In other words, the firearm axis FA is the same no matter the width of the forward portion H of the firearm being clamped.

The base 74 includes wings 74B positioned laterally outboard of the bed 74A for supporting the jaws 76. Standoffs 74C at forward and rear ends of the bed 74A connect the wings 74B to the bed. The base 74 defines rectangular openings between the bed 74A and the wings 74B in which the jaws 76 are received. The jaws 76 each include a rigid backing 76A and a non-marring pad 76B secured to the backing. For example, the pads 76B may be elastomeric material overmolded onto the backing 76A to define inward facing clamping surfaces of the jaws 76 facing the firearm axis FA. The pads 76B have smaller, closely spaced, hexagonal nubs for engaging the firearm F. The jaws 76 can be configured in a clamping position (e.g., FIG. 7) in which the jaws are relatively close to each other for clamping the firearm F and in a non-clamping position (e.g., FIGS. 5, 6, 8) in which the jaws are farther from each other and permit insertion and removal of the firearm therebetween.

The clamp actuator 78 includes a shaft 80 and a knob 82 secured to the shaft by a fastener 84 (e.g., roll pin) such that the knob and shaft rotate conjointly. The shaft 80 extends laterally through the wings 74B and bed 74A of the base 74. The shaft 80 includes a first threaded section 80A extending between the bed 74A and the left wing 74B and a second threaded section 80B extending between the bed 74A and the right wing 74B. The first threaded section 80A is left hand threaded, and the second threaded section 80B is right hand threaded. The first and second threaded sections 80A, 80B form threaded connections with threaded openings 76C in the jaws 76. The arrangement is such that rotation of the knob 82 in a first direction causes the jaws 76 to move closer to the firearm axis FA and to each other to clamp the firearm F, and rotation of the knob in a second opposite direction causes the jaws to move farther from the clamping axis and from each other to unclamp the firearm. It will be appreciated that the clamp actuator 78 moving the jaws 76 at the same time and at the same rate of movement causes the jaws to clamp the firearm F in a centered position on the bed 74A and with respect to the firearm axis FA no matter the width of the firearm at its forward portion H.

Figure 6:
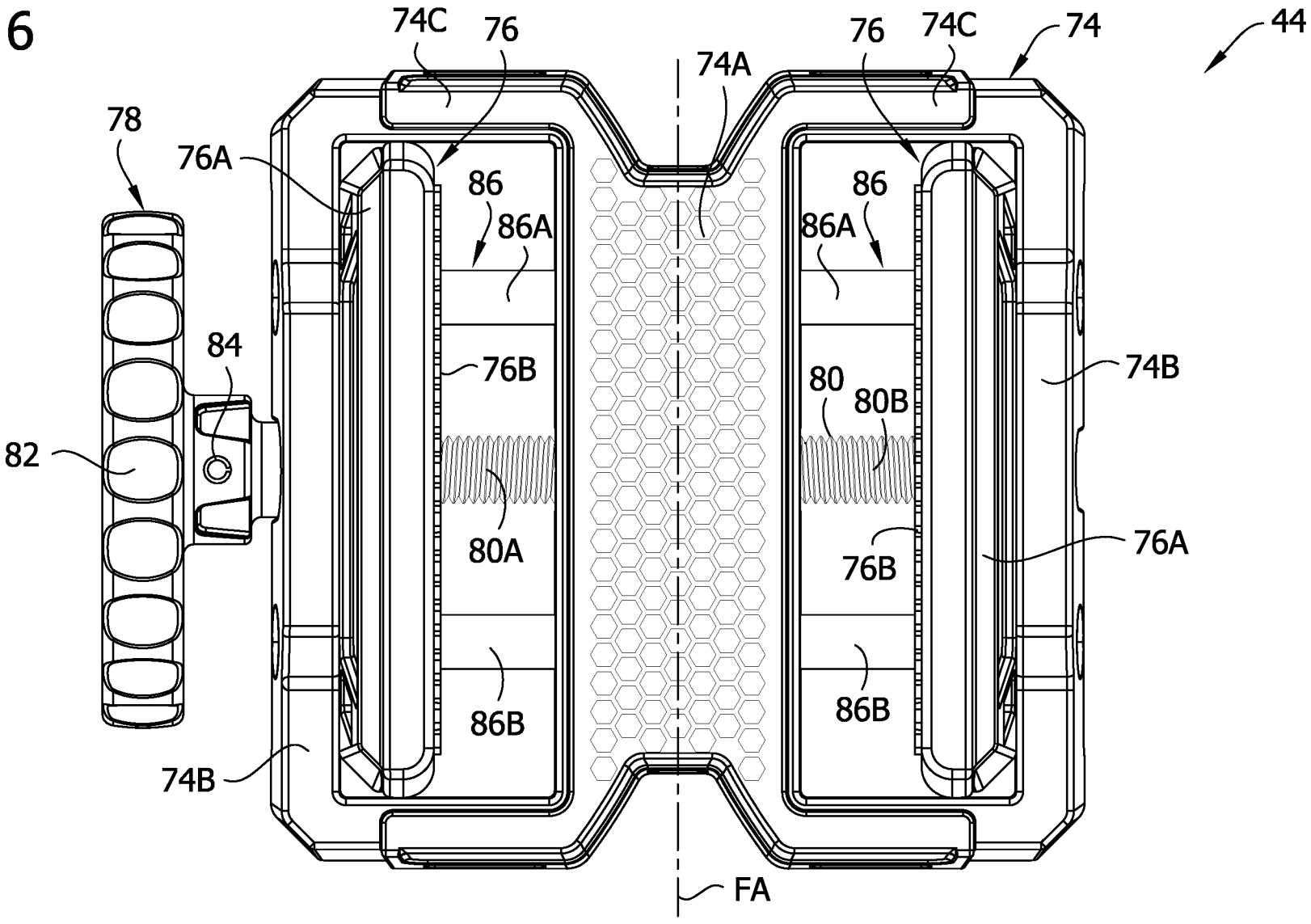
FIG. 6 is a top view of the cradle.
Figure 7:
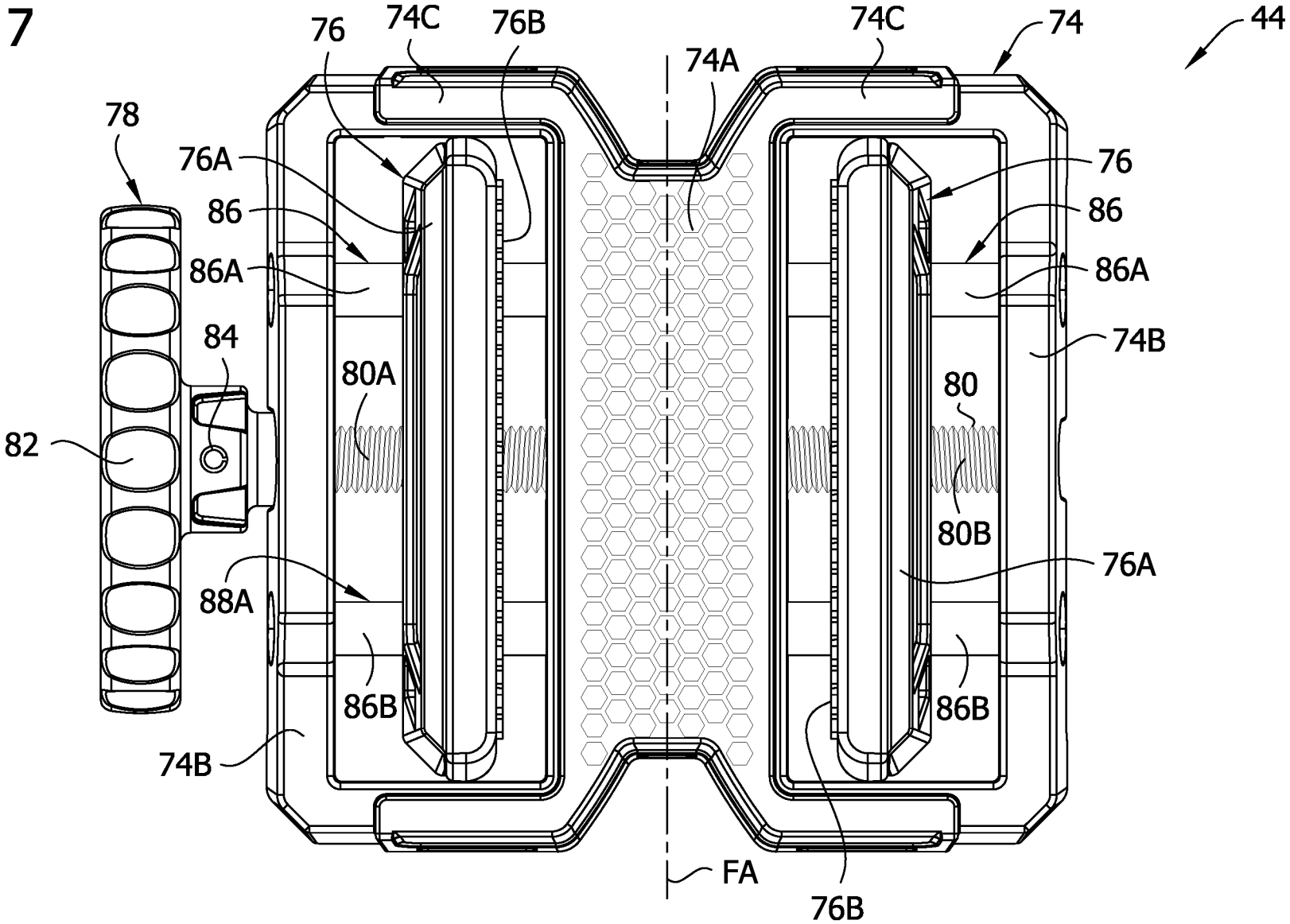
FIG. 7 is a view similar to FIG. 6 but showing jaws of the cradle moved to a clamping position.
Figure 8:
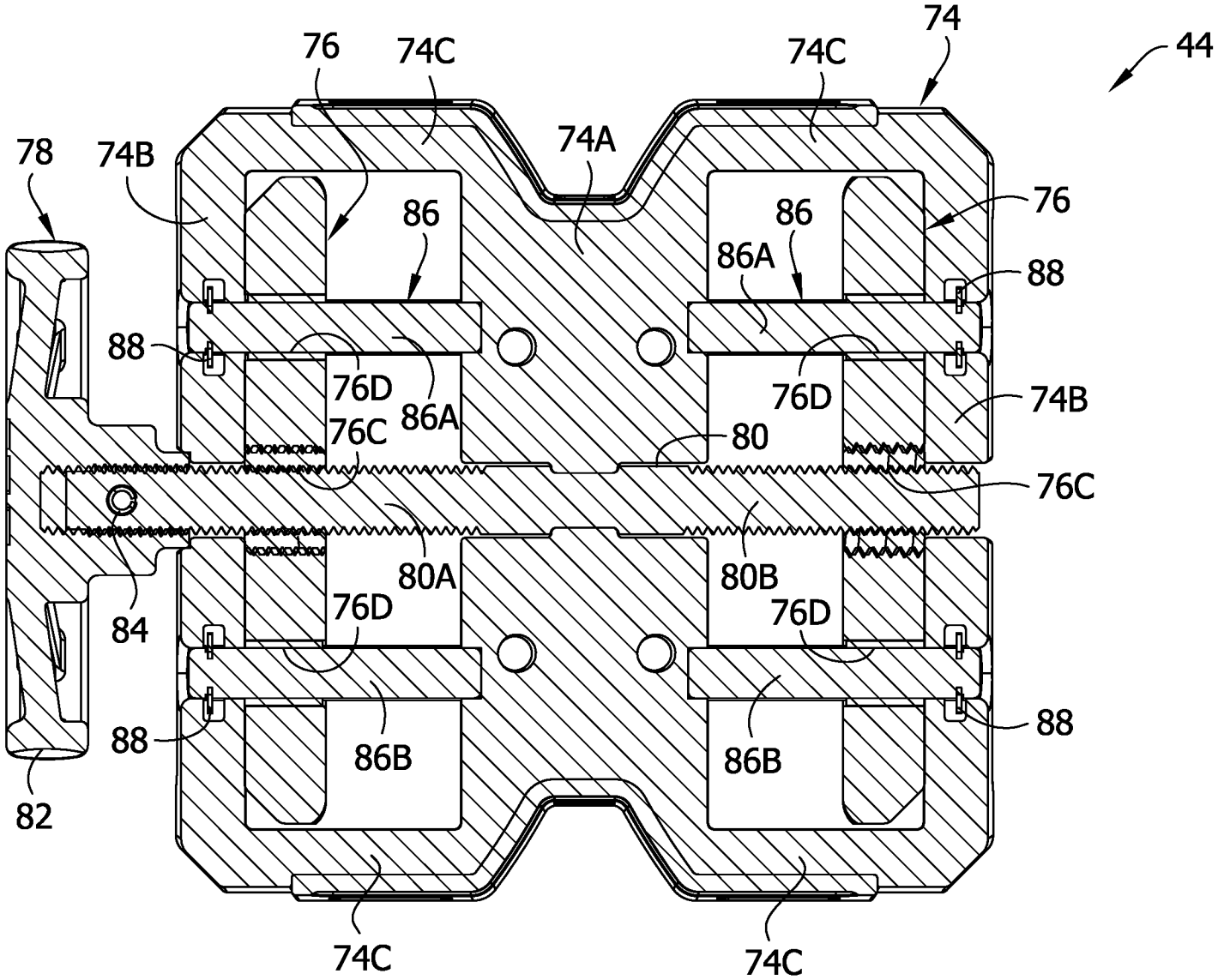
FIG. 8 is a view similar to FIG. 6 but showing the cradle in section.

Referring to FIGS. 6-8, the cradle 44 includes first and second guides 86 configured to guide movement of the jaws 76 between the non-clamping and clamping positions. In the illustrated embodiment, the guides 86 each include a pair of slides 86A, 86B in the form of cylindrical rods extending between the bed 74A and wings 74B. Each pair of slides 86 includes a forward slide 86A forward of the clamp actuator 78 and a rear slide 86B rearward from the clamp actuator. The slides 86A, 86B are mounted on the base 74 by reception of opposite ends of the slides in openings in the bed 74A and wings 74B. In manufacture, the slides 86A, 86B can be inserted through the wings 74B into the bed 74B and be secured in position by installation of fasteners 88 (FIG. 8) such as E-clips on circumferential grooves in the slides through slots in the wings. The jaws 76 include followers 76D (FIG. 8) that are slidable along the slides 86A, 86B to guide movement of the jaws. In the illustrated embodiment, the followers 76D are provided in the form of circular openings in the jaws 76 through which the slides 86A, 86B pass.

Other cradles can be used without departing from the scope of the present invention. For example, other types of clamp actuators can be used. Other types of guides can be used, and the guides can be omitted. For example, other mating relationships of a guide and a jaw can be used. Moreover, the cradle need not be clampable on the firearm. The firearm can be secured in position on the cradle (e.g., by a strap, fastener, etc.) without being clamped between one or more movable jaws. Moreover, the cradle may include a bed without any upstanding members for supporting sides of the firearm.

Referring now to FIGS. 2, 3, 4, 12, and 13, the rear support 16 will now be described in further detail. The rear support 16 includes a platform 90 positioned to support a bottom of the trigger hand grip portion G of the firearm F. The platform 90 defines a deck 90A having an upwardly facing surface positioned to receive the bottom of the trigger hand grip portion G. The deck 90A includes a non-marring pad such as an elastomeric material overmolded onto a rigid backing of the platform. The deck 90A is also formed by a multiplicity of closely spaced, hexagonal nubs. The rear support 16 is mounted on the frame 12 between the two rear legs 20. In particular, the rear support 16 includes two arms 90B pivotally connecting the platform 90 to the brace 21. The arms 90B include openings through which the brace 21 extends and about which the platform 90 is pivotable with respect to the brace. The rear support 16 includes a jack 92 supporting the platform 90 and configured to adjust an elevation of the platform to adjust a vertical aim of the firearm F. In the illustrated embodiment, the jack 92 comprises a turn buckle including a wheel 92A and first and second shafts 92B, 92C connected to the wheel. The arms 90A of the platform 90 provide a space between the brace 21 and the remainder of the platform. An upper portion of the wheel 92A projects through this space for ease of access by the user, even when the grip G of the firearm F is resting on the platform. The turn buckle 92 is secured to the brace 21 by a pivot mount 94 including a collar 94A and first and second brackets 94B extending downward from the collar. The turn buckle 92 is secured to the platform 90 by two brackets 90C extending downward below the deck 90A. The first shaft 92B is pivotally secured to the pivot mount brackets 94B by a pin 96 and is rotatably connected to and fixed in axial position with respect to the wheel 92A. The second shaft 92C is pivotally secured to the platform brackets 90C by a pin 98 and includes a threaded portion forming a threaded connection with a threaded bore in the wheel 92A. The arrangement is such that rotation of the wheel 92A tending to decrease the length of the turn buckle 92 causes the turn buckle to lower the platform 90, and rotation of the wheel tending to increase the length of the turn buckle causes the turn buckle to raise the platform. Accordingly, the turn buckle 92 permits a user to raise and lower the trigger hand grip portion G of the firearm F resting on the deck 90A to lower and raise the vertical aim of the firearm.

Other types of rear supports can be used without departing from the scope of the present invention. For example, other types of jacks can be provided. Moreover, the rear support can be removable or be omitted without departing from the scope of the present invention. In one contemplated embodiment, the brace 21 is removable (e.g., by unfastening the brace 21 from the rear legs 20) to remove the rear support 16, such that the rest can be used without the rear support.

In a method of using the shooting rest 10, the shooting rest can be positioned at a location where the user desires to shoot and can be oriented with the forward and rear supports 14, 16 aligned in a general direction in which the user desires to shoot. The user then sets the firearm F on the rest 10 with the forward portion H of the firearm F on the forward support 14 and the bottom of the trigger hand grip portion G on the rear support 16. The clamp actuator 78 is used to clamp the forward portion H of the firearm F with the jaws 76 of the cradle 44. The shooting rest 10 can be used in a bench rest mode and in a turret rest mode. As used herein, bench rest mode refers to a mode in which the firearm F is resting on both the forward rest 14 and the rear rest 16. In this mode, the shooting rest 10 can be used as a bench rest fully supporting the firearm F and permitting fine adjustment of the aim of the firearm while supported by the shooting rest. The yaw and pitch brakes 56, 64 can be in the non-braking, braking, or locked positions, but desirably, the yaw and pitch brakes are in the braking or locked positions. The user can make coarse vertical aim adjustment by changing the length of the front leg 20, and can make fine vertical aim adjustment by rotating the wheel 92A of the turn buckle 92 of the rear support 16. Elevating or lowering the trigger hand grip portion G causes the firearm F to pivot about the pitch axis PA at the forward support 14. Major horizontal aim adjustments can be made by turning the shooting rest 10 to change the orientation of the legs 20, and fine horizontal aim adjustments can be made by sliding the bottom of the trigger hand grip portion G left or right on the deck 90A of the rear support 16. In this way, the shooting rest 10 can be used as a bench rest to fully support the weight of the firearm F and precisely aim the firearm at a desired target. In the turret rest mode, the user can lift the trigger hand grip portion G off the rear support 16 and rotate the firearm F as desired about the yaw axis YA and/or pitch axis PA of the forward support 14 to aim the firearm F. In the turret rest mode, the yaw and pitch brakes 56, 64 can be in the non-braking, braking, and/or locking positions, but at least one of the yaw and pitch brakes is not in the locking position. In the turret rest mode, the user benefits from the clamping of the cradle 44 on the firearm F and the tripod support of the frame 12 to provide stability to the firearm in aiming. The turret rest mode can be useful to the user in dynamic shooting situations, such as when shooting moving targets or when rapidly changing aim of the firearm toward various targets. In the turret rest mode, the user can rest the trigger hand grip portion G on the rear support 16 when waiting to acquire a target or when taking a break from shooting. When the user is finished using the rest 10, the firearm F is unclamped from the forward support 14 and removed from the rest.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A shooting rest for supporting a firearm, the firearm including a trigger and a forward portion forward of the trigger, the shooting rest comprising:

a cradle for supporting the forward portion of the firearm, the cradle including first and second jaws, a bed between the jaws, and an actuator, the first jaw including a first threaded opening, the actuator including a shaft having a first threaded section, the first threaded section being threaded in the first threaded opening, the first and second jaws being movable with respect to the bed to clamp the forward portion of the firearm between the jaws, the actuator being operable to move the first and second jaws toward each other with respect to the bed to clamp the forward portion of the firearm between the jaws, the actuator configured to move the first jaw by rotation of the first threaded section in the first threaded opening;

wherein the cradle includes first and second wings spaced laterally outboard from the bed, the first jaw being located at least partially between the bed and the first wing, the second jaw being located at least partially between the bed and the second wing;

wherein the first and second jaws each have a retracted position and a clamping position, the jaws being closer to each other in their clamping positions than in their retracted positions, the cradle including a first guide extending between the bed and the first wing, the cradle including a second guide extending between the bed and the second wing, the first jaw including at least one follower movable along the first guide for guiding movement of the first jaw between the retracted and clamping positions, and the second jaw including at least one follower movable along the second guide for guiding movement of the second jaw between the retracted and clamping positions.

2. The shooting rest as set forth in claim 1, wherein the shaft includes a second threaded section, the second jaw including a second threaded opening, the second threaded section being threaded in the second threaded opening, the first threaded section being a left hand threaded section, and the second threaded section being a right hand threaded section.

3. The shooting rest as set forth in claim 2, wherein the first threaded section of the shaft extends between the bed and the first wing, and the second threaded section of the shaft extends between the bed and the second wing.

4. The shooting rest as set forth in claim 2, wherein the shaft further includes an unthreaded section between the first threaded section and the second threaded section, the bed comprising a passage rotatably receiving the unthreaded section.

5. The shooting rest as set forth in claim 1, further comprising a frame, the cradle supported by the frame, the cradle being pivotable with respect to the frame to adjust an aim of the firearm while the firearm is clamped by the cradle.

6. The shooting rest as set forth in claim 5, wherein the firearm support includes a stem connected to the frame, the stem defining a generally vertical pivot axis about which the cradle is pivotable with respect to the frame to adjust a horizontal aim of the firearm while the firearm is clamped by the cradle.

7. The shooting rest as set forth in claim 6, wherein the firearm support includes a hub having a pivot connection with the stem, the hub being pivotable with respect to the stem about a generally horizontal axis to adjust a vertical aim of the firearm while the firearm is clamped by the cradle.

8. The shooting rest as set forth in claim 5, wherein the cradle is pivotable with respect to the frame about a pitch axis to adjust a vertical aim of the firearm while the firearm is clamped by the cradle, and the cradle is pivotable with respect to the frame about a yaw axis to adjust a horizontal aim of the firearm while the firearm is clamped by the cradle.

9. The shooting rest as set forth in claim 8, wherein the front support includes a hub and a stem, the hub pivotally connected to the stem and permitting pivoting of the cradle with respect to the frame about the pitch axis.

10. The shooting rest as set forth in claim 9, wherein the stem is pivotally connected to the frame and permits pivoting of the cradle with respect to the frame about the yaw axis.

11. The shooting rest as set forth in claim 10, wherein the frame includes a yoke and a plurality of legs extending from the yoke, the stem pivotally connected to the yoke for rotation about the yaw axis.

12. The shooting rest as set forth in claim 5, wherein the frame includes a yoke and a plurality of legs extending from the yoke, the firearm support extending upward from the yoke.

13. The shooting rest as set forth in claim 1, wherein the shaft extends through the bed.

14. The shooting rest as set forth in claim 1, wherein the at least one follower of the first jaw includes an opening in which the first guide is received, and wherein the at least one follower of the second jaw includes an opening in which the second guide is received.

15. The shooting rest as set forth in claim 1, wherein the actuator is operable to move the first and second jaws toward each other at the same time.

16. The shooting rest as set forth in claim 15, wherein the actuator is operable to move the first and second jaws toward each other at the same rate of movement.

17. A shooting rest for supporting a firearm, the firearm including a trigger and a forward portion forward of the trigger, the shooting rest comprising:

a cradle for supporting the forward portion of the firearm, the cradle including first and second jaws, a bed between the jaws, and an actuator, the first jaw including a first threaded opening, the actuator including a shaft having a first threaded section, the first threaded section being threaded in the first threaded opening, the first and second jaws being movable by the actuator with respect to the bed to clamp the forward portion of the firearm between the jaws, the actuator configured to move the first jaw by rotation of the first threaded section in the first threaded opening, wherein the shaft includes a second threaded section, the second jaw including a second threaded opening, the second threaded section being threaded in the second threaded opening, the first threaded section being a left hand threaded section, and the second threaded section being a right hand threaded section;

wherein the cradle includes first and second wings spaced laterally outboard from the bed, the first jaw being located at least partially between the bed and the first wing, the second jaw being located at least partially between the bed and the second wing, the first threaded section of the shaft extending between the bed and the first wing, and the second threaded section of the shaft extending between the bed and the second wing; and wherein the first and second jaws each have a retracted position and a clamping position, the jaws being closer to each other in their clamping positions than in their retracted positions, the cradle including first and second guides, the first jaw including at least one follower movable along the first guide for guiding movement of the first jaw between the retracted and clamping positions, and the second jaw including at least one follower movable along the second guide for guiding movement of the second jaw between the retracted and clamping positions.

18. The shooting rest of claim 17, wherein the shaft extends through the bed.

19. The shooting rest as set forth in claim 17, further comprising a frame, the cradle supported by the frame, the cradle being pivotable with respect to the frame to adjust an aim of the firearm while the firearm is clamped by the cradle.

20. The shooting rest as set forth in claim 19, wherein the firearm support includes a stem connected to the frame, the stem defining a generally vertical pivot axis about which the cradle is pivotable with respect to the frame to adjust a horizontal aim of the firearm while the firearm is clamped by the cradle.

21. The shooting rest as set forth in claim 20, wherein the firearm support includes a hub having a pivot connection with the stem, the hub being pivotable with respect to the stem about a generally horizontal axis to adjust a vertical aim of the firearm while the firearm is clamped by the cradle.

22. The shooting rest as set forth in claim 17, wherein the frame includes a yoke and a plurality of legs extending from the yoke, the firearm support extending upward from the yoke.

23. The shooting rest as set forth in claim 17, wherein the at least one follower of the first jaw includes an opening in which the first guide is received, and wherein the at least one follower of the second jaw includes an opening in which the second guide is received.

24. A shooting rest for supporting a firearm, the firearm including a trigger and a forward portion forward of the trigger, the shooting rest comprising:

a cradle for supporting the forward portion of the firearm, the cradle including first and second jaws, a bed between the jaws, and an actuator, the first jaw including a first threaded opening, the actuator including a shaft having a first threaded section, the first threaded section being threaded in the first threaded opening, the first and second jaws being movable by the actuator with respect to the bed to clamp the forward portion of the firearm between the jaws, the actuator configured to move the first jaw by rotation of the first threaded section in the first threaded opening, wherein the shaft includes a second threaded section, the second jaw including a second threaded opening, the second threaded section being threaded in the second threaded opening, the first threaded section being a left hand threaded section, and the second threaded section being a right hand threaded section;

wherein the cradle includes first and second wings spaced laterally outboard from the bed, the first jaw being located at least partially between the bed and the first wing, the second jaw being located at least partially between the bed and the second wing, the first threaded section of the shaft extending between the bed and the first wing, and the second threaded section of the shaft extending between the bed and the second wing;

wherein the first wing defines a first opening in which the first jaw is received, and the second wing defines a second opening in which the second jaw is received.

25. The shooting rest of claim 24, wherein the first and second jaws each have a retracted position and a clamping position, the jaws being closer to each other in their clamping positions than in their retracted positions, the cradle including a first guide extending across the first opening, the cradle including a second guide extending across the second opening, the first jaw including at least one follower movable along the first guide for guiding movement of the first jaw between the retracted and clamping positions, and the second jaw including at least one follower movable along the second guide for guiding movement of the second jaw between the retracted and clamping positions.

26. The shooting rest as set forth in claim 24, further comprising a frame, the cradle supported by the frame, the cradle being pivotable with respect to the frame to adjust an aim of the firearm while the firearm is clamped by the cradle.

27. The shooting rest as set forth in claim 26, wherein the frame includes a yoke and a plurality of legs extending from the yoke, the firearm support extending upward from the yoke.

* * * * *